US008245414B2

(12) United States Patent
Watson et al.

(10) Patent No.: US 8,245,414 B2
(45) Date of Patent: Aug. 21, 2012

(54) DRYING DRAWER AND METHOD OF DRYING

(75) Inventors: Eric K. Watson, Crestwood, KY (US); Derek Lee Watkins, Elizabethtown, KY (US); John K. Besore, Prospect, KY (US); Subhash Viswanathan Kollengode, Andhra Pradesh (IN); Yogesh Kumar Allimalli, Andhra Pradesh (IN); Sarah Lynn Kirchoff, Hartland, WI (US); Kyle Eden, Louisville, KY (US); David Scott Dunn, Smithfield, KY (US); David D. Warmuth, Louisville, KY (US)

(73) Assignee: General Electric Company, Schenectady, NY (US)

( * ) Notice: Subject to any disclaimer, the term of this patent is extended or adjusted under 35 U.S.C. 154(b) by 538 days.

(21) Appl. No.: 12/552,320

(22) Filed: Sep. 2, 2009

(65) Prior Publication Data

US 2011/0047814 A1 Mar. 3, 2011

(51) Int. Cl.
*F26B 25/06* (2006.01)

(52) U.S. Cl. ..... 34/381; 34/497; 34/601; 34/218; 68/18 F; 68/18 R

(58) Field of Classification Search ..... 34/381, 34/413, 497, 595, 90, 218, 601, 610; 68/18 F, 68/18 R; 134/2, 33, 42
See application file for complete search history.

(56) References Cited

U.S. PATENT DOCUMENTS

| | | | | |
|---|---|---|---|---|
| 2,249,624 | A * | 7/1941 | Bichowsky | 34/473 |
| 2,442,148 | A * | 5/1948 | Rose | 34/526 |
| 3,402,477 | A | 9/1968 | Hubbard | |
| 3,750,304 | A * | 8/1973 | Ghadiali | 34/566 |
| 3,866,336 | A | 2/1975 | Bereza | |
| 3,882,612 | A * | 5/1975 | Try et al. | 34/479 |
| 3,905,126 | A * | 9/1975 | Villalobos et al. | 34/72 |
| 4,549,362 | A * | 10/1985 | Haried | 34/395 |
| 4,771,552 | A * | 9/1988 | Morioka | 34/222 |
| 5,187,879 | A * | 2/1993 | Holst | 34/261 |
| 5,528,839 | A * | 6/1996 | Seidl | 34/364 |
| 5,546,678 | A * | 8/1996 | Dhaemers | 34/275 |

(Continued)

FOREIGN PATENT DOCUMENTS

DE 19641404 A1 * 4/1998

(Continued)

*Primary Examiner* — Stephen M. Gravini

(74) *Attorney, Agent, or Firm* — Faye Sharpe LLP

(57) ABSTRACT

A dryer drawer system is provided comprising a generally multisided drying chamber having opposed side walls, a rear wall, and at least one access door, wherein the door is sealable to the chamber. The dryer drawer further comprises a heater for heating air circulating in the chamber and at least one fan for circulating air in the chamber. The multisided drying chamber includes an air inlet and an air outlet, a sensor for sensing the temperature of the air in the chamber, a first damper for selectively opening and closing the air inlet, a second damper for selectively opening and closing the air outlet, and a controller for controlling operation of the fan, the heater and the dampers. The controller is operative in a first operational mode to open the air inlet and the air outlet to provide air flow through the chamber and in a second operational mode to close the air inlet and the air outlet to provide a recirculating air flow within the chamber. The controller can selectively switch between the first and second modes as a function of the sensed temperature in the chamber.

25 Claims, 11 Drawing Sheets

U.S. PATENT DOCUMENTS

| | | | | |
|---|---|---|---|---|
| 5,555,640 | A | 9/1996 | Ou | |
| 5,870,836 | A | 2/1999 | Grimes | |
| 6,005,227 | A | 12/1999 | Pappas | |
| 6,088,932 | A * | 7/2000 | Adamski et al. | 34/274 |
| 7,055,262 | B2 | 6/2006 | Goldberg | |
| 7,191,546 | B2 | 3/2007 | Maruca | |
| 7,377,052 | B2 | 5/2008 | Maruca | |
| 7,513,132 | B2 * | 4/2009 | Wright et al. | 68/18 F |
| 2005/0155393 | A1 * | 7/2005 | Wright et al. | 68/3 R |
| 2006/0179676 | A1 | 8/2006 | Goldberg | |
| 2006/0218812 | A1 | 10/2006 | Brown | |
| 2006/0254082 | A1 | 11/2006 | Kim | |
| 2007/0068036 | A1 | 3/2007 | Choi | |
| 2007/0144032 | A1 | 6/2007 | Maruca | |
| 2007/0256320 | A1 * | 11/2007 | Pearson | 34/498 |
| 2011/0047814 | A1 * | 3/2011 | Watson et al. | 34/507 |
| 2012/0055039 | A1 * | 3/2012 | Watson et al. | 34/218 |

FOREIGN PATENT DOCUMENTS

| | | | | |
|---|---|---|---|---|
| DE | 102006049437 | B3 * | 3/2008 | |
| EP | 927862 | A1 * | 7/1999 | |
| JP | 60079254 | A * | 5/1985 | |
| JP | 2006010135 | A * | 1/2006 | |

* cited by examiner

DRYING DRAWER AND METHOD OF DRYING

BACKGROUND

The present disclosure relates to a dryer (or drying) drawer. More particularly, the present disclosure relates to drying drawers employing circulating drying air through the drawer.

Traditionally, dryers use very high wattage heaters and open ducts to allow the free flow of air to remove water from clothing articles. Clothing is tumbled during this process which can cause garment wear. Also, the traditional drying process is not conducive for shoes and other bulky items. The problem solved is to drastically reduce the time required to dry articles of clothing et al., while minimizing the energy required to complete the drying cycle.

The use of drawer type dryers or compartment dryers can be particularly effective for woolens and delicate items (i.e. sweaters) which are not well suited for drying by conventional tumble dryers. In addition, other clothing items not well suited for tumbling, i.e. shoes, gloves, etc., can also effectively be dried with a drying drawer. Also, in locations where energy is at a premium, drying drawers can be more energy efficient than conventional dryers. In drying drawers, the clothes can be placed or positioned on a support rack. The drying drawers can simply circulate outside air through the cabinet in cases where the outside air is relatively dry. Heaters may also be used to heat the air supplied to the drying drawer. In still other embodiments, air is at least partially recirculated through the drawer while moisture is removed from the recirculating air so as to maintain a supply of drying air and to reduce the remaining moisture content (RMC) of the articles therein.

SUMMARY

In one aspect of the present disclosure, a dryer drawer system is provided comprising a generally multisided drying chamber having opposed side walls, a rear wall, and at least one access door, wherein the door is sealable to the chamber. The system further provides a heater for increasing the temperature of the air in the chamber to evaporate moisture from the articles in the chamber; a sensor for sensing the temperature of the air in the chamber, at least one fan for circulating air in or through the chamber; a damper controlled air inlet connected with the multisided drying chamber; and, a damper controlled air outlet connected with the multisided drying chamber. Air flow through the chamber is provided in a first operational mode when the inlet and outlet are opened and a recirculating air flow is provided within the chamber in a second operational mode when the inlet and outlet are closed. The controller selectively switches between the first and second operational modes as a function of the sensed temperature in the chamber.

In another aspect of the present disclosure, a dryer drawer is provided comprising a generally multisided drying chamber having opposed side walls, a rear wall, and at least one access door. The drying chamber further includes an air inlet and an air outlet. A sensor is provided for measuring temperature in the chamber. The multisided drying chamber includes an air flow through the chamber in a first operational mode when the chamber is at a first temperature. The multisided drying chamber includes a recirculating air flow within the chamber in a second operational mode when the chamber is at a second temperature. A heater is provided for heating the air circulating in the chamber to evaporate moisture from articles in the chamber, wherein the heater alternates between on for the first operational mode and off for the second operational mode.

In still a further aspect of the present disclosure, a method of drying articles is provided comprising heating a drying chamber with a heater, wherein the chamber includes a generally multisided drying drawer having opposed side walls, a rear wall, and at least one access door. The method further comprises exhausting air from the drawer through an air outlet including a first damper for selectively opening and closing the air outlet, and drawing air into the drawer through an air inlet including a second damper for selectively opening and closing the air inlet. The method further comprises measuring a temperature in the drawer, streaming air through the drawer in a first operational mode when the first damper and the second damper are opened, recirculating air within the drawer in a second operational mode when the first damper and the second damper are closed, and switching in a series of cycle durations from the first operational mode to the second operational mode when a first predetermined criteria is reached and from the second operational mode to the first operational mode when a second predetermined criteria is reached.

DETAILED DESCRIPTION

Figure 1:
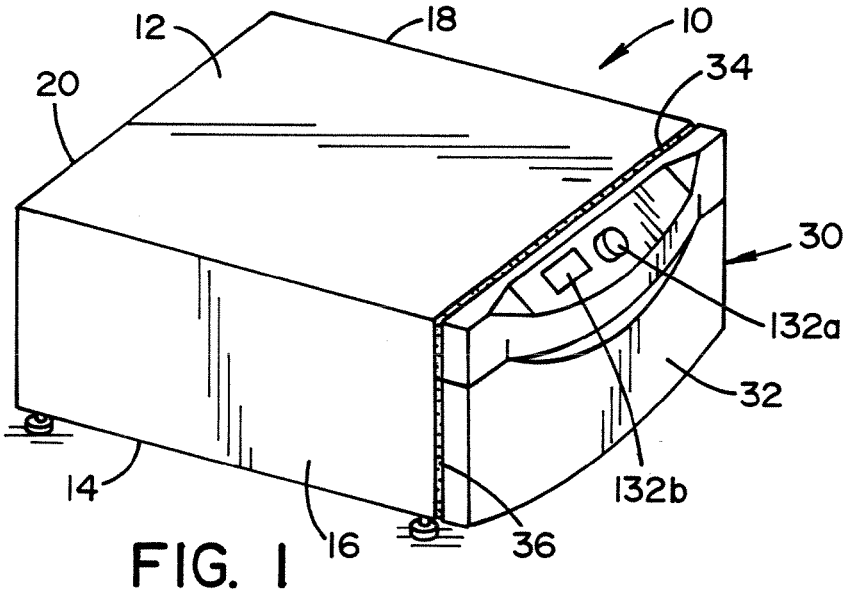
FIG. 1 is a perspective view of the dryer drawer according to the present disclosure in the closed position.
Figure 2:
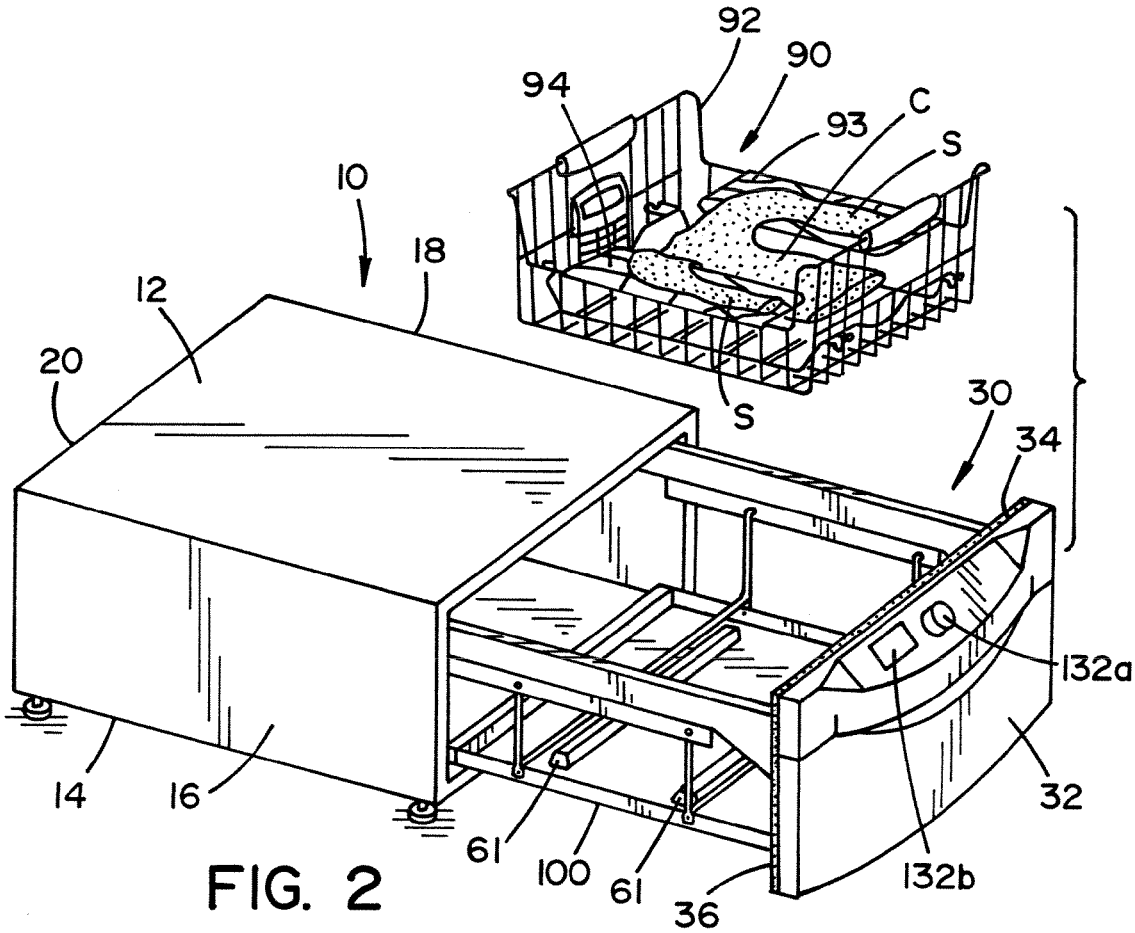
FIG. 2 is a perspective view of the dryer drawer according to the present disclosure in the open position with a basket drawer removed.
Figure 3:
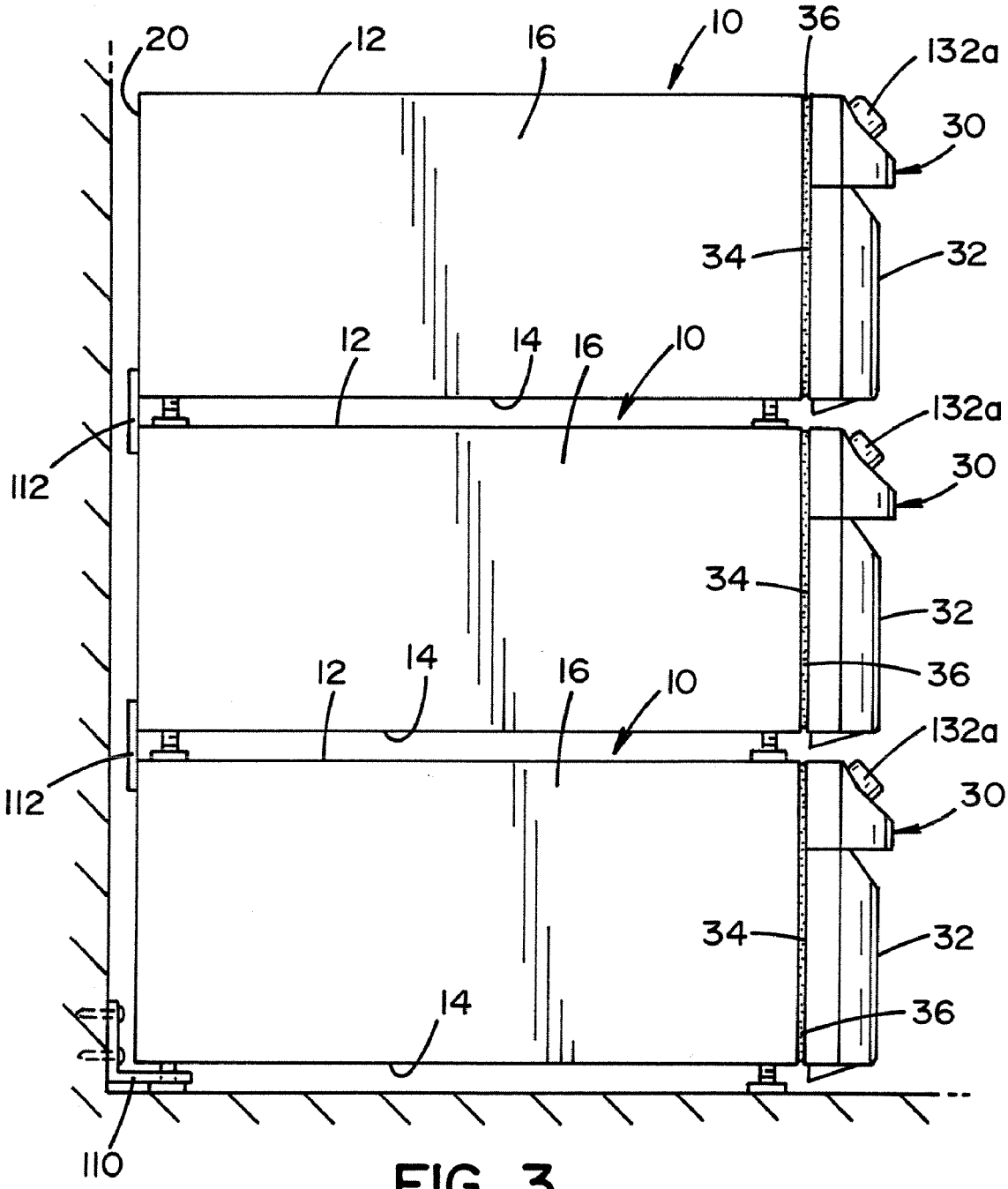
FIG. 3 is a side elevational view of a plurality of dryer drawers mounted to one another.
Figure 4:
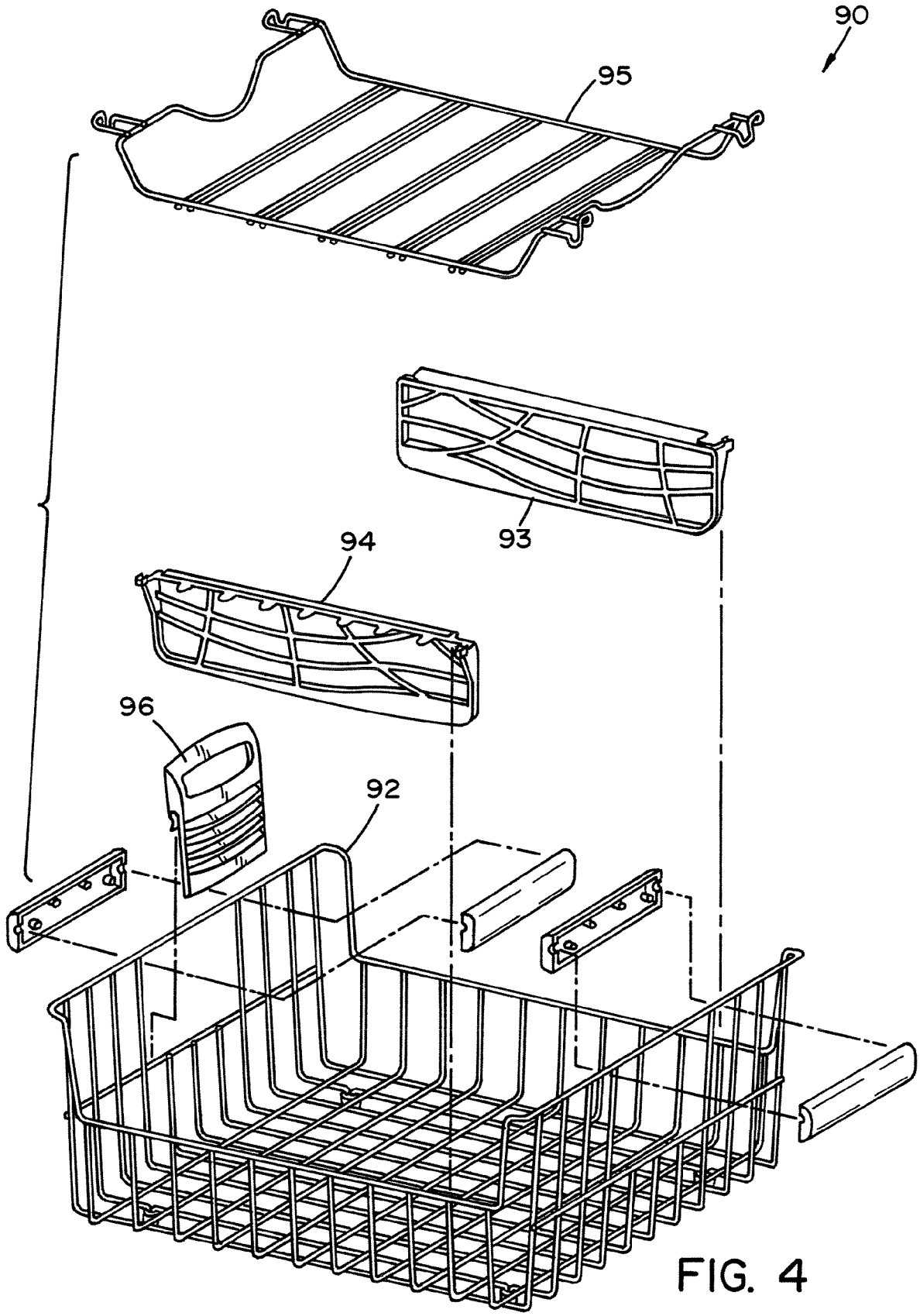
FIG. 4 is an exploded perspective view of a basket assembly for placement within the dryer drawer including sleeve and/or accessory racks.
Figure 6:
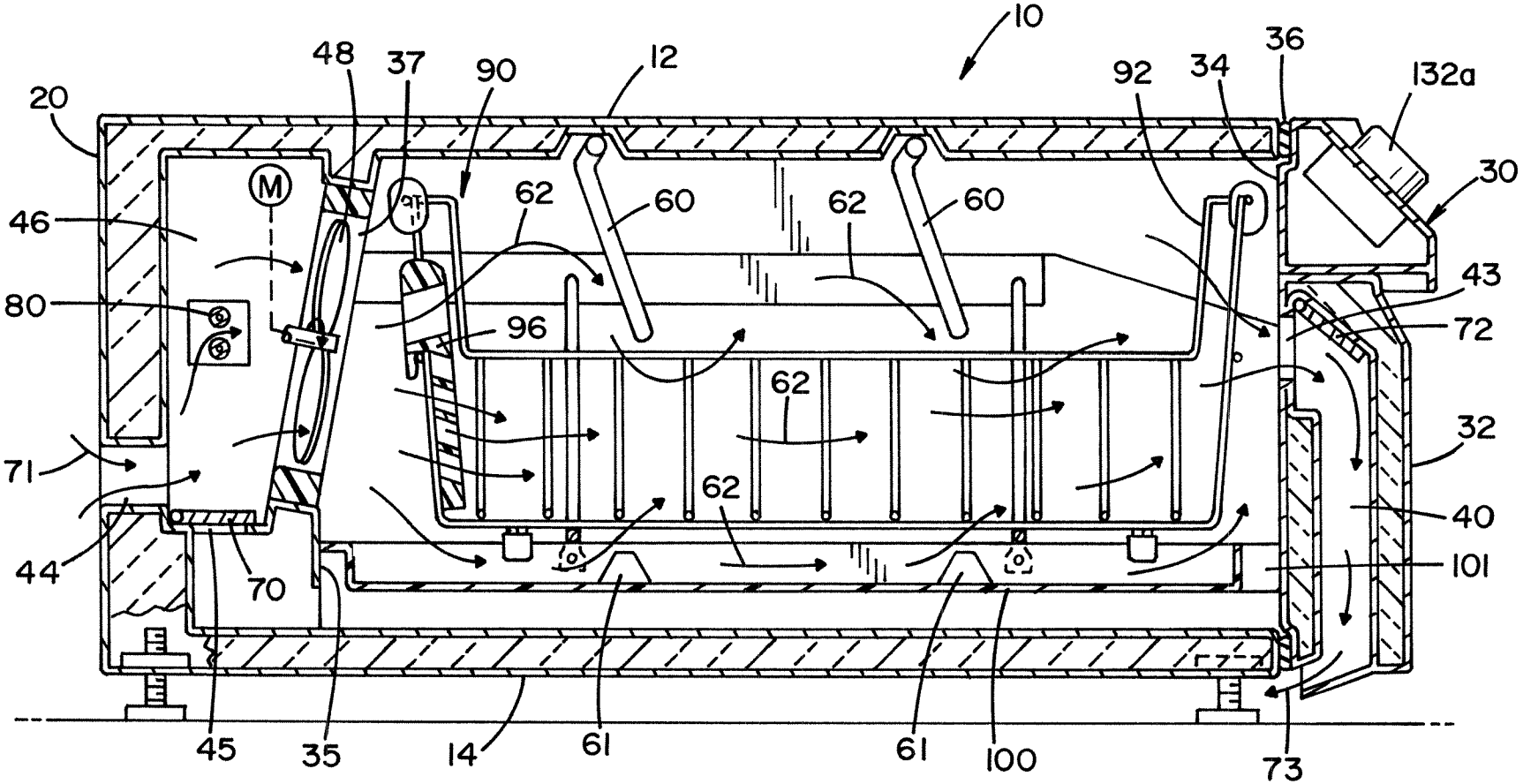
FIG. 6 is a sectional view of the dryer drawer displaying the flow of air in a pass-through mode or first mode of operation.
Figure 7:
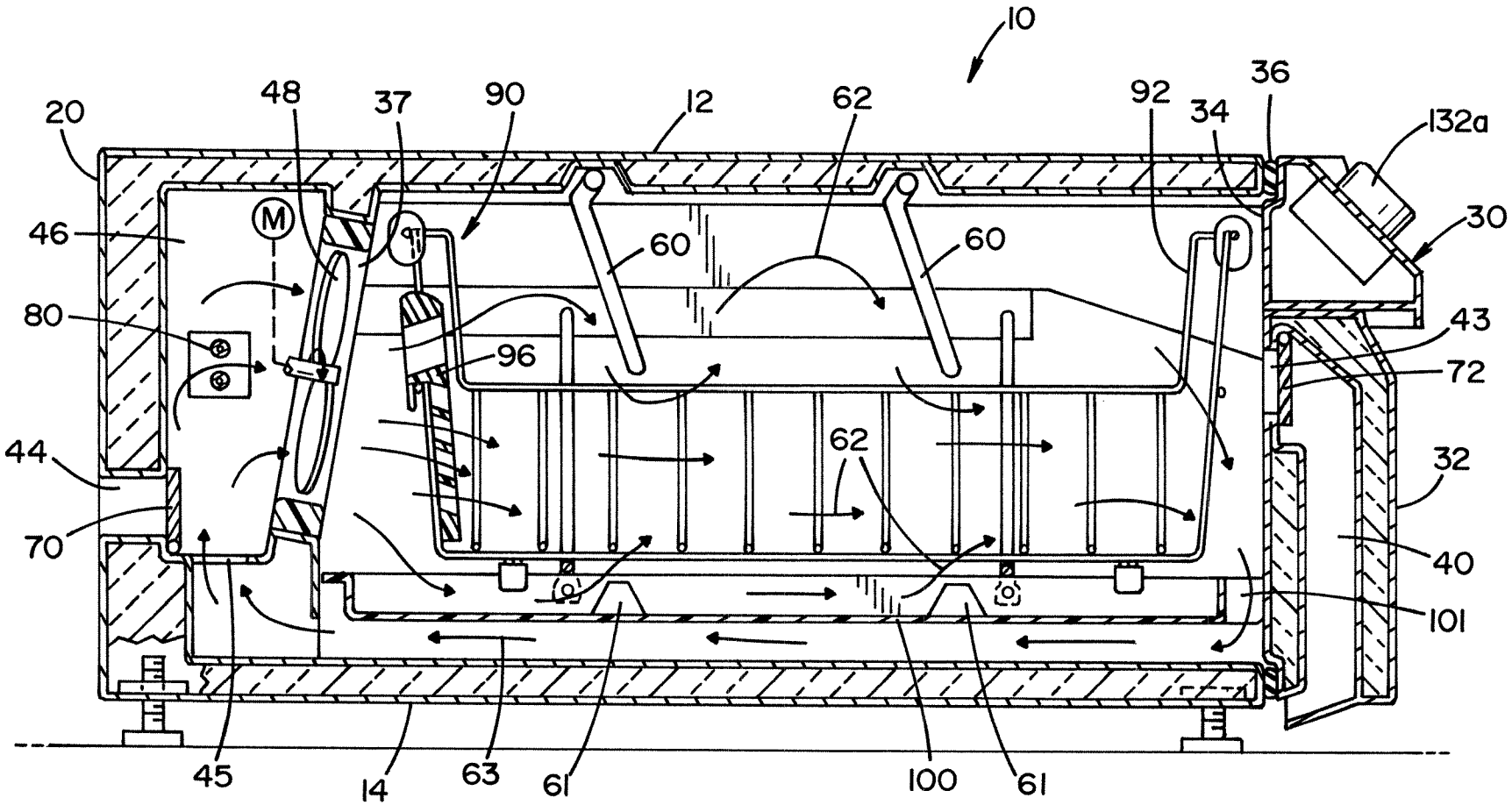
FIG. 7 is a sectional view of the dryer drawer displaying the flow of air in a recirculation path or second mode of operation.

In accordance with the disclosure, and as is best seen in FIGS. 1-3, a rectangular or multi-sided compartment or cabinet 10 having top 12, bottom 14, side 16, 18 and rear 20 walls, which can be associated with a typical dryer drum or as a stand-alone unit, and which is provided with a drawer 30 including drawer slides and mounted for slidable movements into and out of compartment 10 through an open front or access door 32. The compartment 10 is closed by the front wall 34 of drawer 30, which can include a peripherally extending gasket 36 that seals against the compartment 10 to render it air-tight when the drawer 30 is closed. The interior of compartment 10 comprises the drying chamber. As is best seen in FIG. 2, and in cross section FIGS. 6-7, compartment 10 includes an air inlet 44 through the rear wall 20 which is in airflow communication with an air exhaust duct 40 via fan inlet area 46 and outlet opening 43 through front wall 34. Fan inlet area 46 is bounded by rear wall 20, top wall 12 and fan supporting partition 35. Partition 35 defines aperture 37 which receives fan 48 and recirculating air opening 45. Air passes from fan inlet area 46 into the interior of the drying chamber through aperture 37 and recirculating air returns to fan inlet area 46 through opening 45. Heater 80, which in the illustrative embodiment is a conventional electrical resistance heater, but could be any suitable electrically energized heating device, is mounted to side wall 18 and projects into the interior of fan inlet area 46 for heating the air that is circulated through the chamber. A temperature sensor 39, (not shown except in FIG. 5) is suitably mounted in the interior of compartment 10 to sense the temperature of the air circulating in the drying chamber. The interior of the compartment 10 can enclose a wire frame or basket arrangement 90. A series of retractable baffles 60 can depend from the top and a series of stationary baffles 61 can depend from the bottom of the inside of compartment 10 to ensure that air will flow through the compartment 10 in the path indicated by line arrows 62. In one illustrative embodiment, to provide for selectivity of air flow through the compartment 10, a damper 70 can be hingedly mounted proximate inlet 44 for pivotal movements between the open and closed positions as shown in FIGS. 6 and 7, respectively. In the open position damper 70 opens air inlet 44 and closes recirculating air opening 45 to facilitate airflow through the drying chamber as shown in FIG. 6. In the closed position, damper 70 closes the air inlet 44 and opens opening 45 to facilitate recirculating airflow as shown in FIG. 7. Pivotal movements of damper 70 can be effected by suitable electromechanical means. Such means can include a solenoid operably coupled with damper 70.

To be described in more detail hereinafter, the drawer 30 can include an automatic end of cycle detector based upon a predetermined criteria, for example, remaining moisture content (RMC) of clothing C or other articles therein which can be related to the decreasing time between temperature peaks. A ramp up damper cycling algorithm can be used to release moist air early during ramp up of a heat cycle in order to reduce time to reach a maximum temperature set point for drying. In addition, a current sensing circuit can be used to disable a heater 80 when additional loads are plugged in the unit to prevent tripping a circuit breaker. In conjunction with the damper cycling algorithm, a dual acting damper cycling process can simultaneously power at least two dampers 70, 72 to release moist air 73 while bringing in fresh non-moist air 71 into the system. Closing of a recirculation air path when drawing fresh outside air through the use of the dual acting damper facilitates the damper cycling and drying efficiency.

The drying compartment 10 further provides for a controlled air return path for preventing of short circuiting/bypassing of the system air flow through the use of baffling 60, 61 in order to force return air to flow to the front of, and around, an interior basket 90 (to be described hereinafter). A generally planar partition 100 can extend beneath basket 90 from front wall 34 to the fan supporting partition 35. Partition 100 can be spaced from bottom wall 14, to provide a return air flow path for air to return to the fan inlet area 46 when operating in the recirculating mode, and to serve as a drip shield. An opening 101 which may be an elongated gap or a plurality of slots or holes in partition 100, is provided proximate where the partition 100 meets front wall 34, to enable recirculating air to enter the space beneath the partition and return to fan inlet area 46. Partition 100 can be made of a material to lower the thermal mass of the system, wherein a lower overall thermal mass within the system aids in faster ramp up time to reach a predetermined temperature. The recirculating air path back to the fan inlet area is completed through opening 45 formed in the horizontally extending portion of the fan supporting partition 35.

As hereinbefore described, the partition or drip shield 100 separates areas within the drying chamber between a low pressure side and a high pressure side with respect to the fan 48. The material for the drip shield 100 can be selected from the group consisting of plastic, glass, and metal and can also comprise a heat source (not illustrated) for generating local heat, i.e. conductively, radiatively, convectively, etc., to the clothing articles C proximal to the shield. The drip shield 100 can also include perforations (not shown) for enhancing the circulation of air through and around the chamber. A mounting mechanism can be used to prevent unit tip over through the use of, for example, wall mounting brackets 110 and/or unit to unit mounting brackets 112. The above described elements reduce drying time, lower energy consumption, increase consumer convenience, and enable drying of articles not particularly suited for tumble drying (i.e., shoes, sweaters, etc.).

Figure 5:
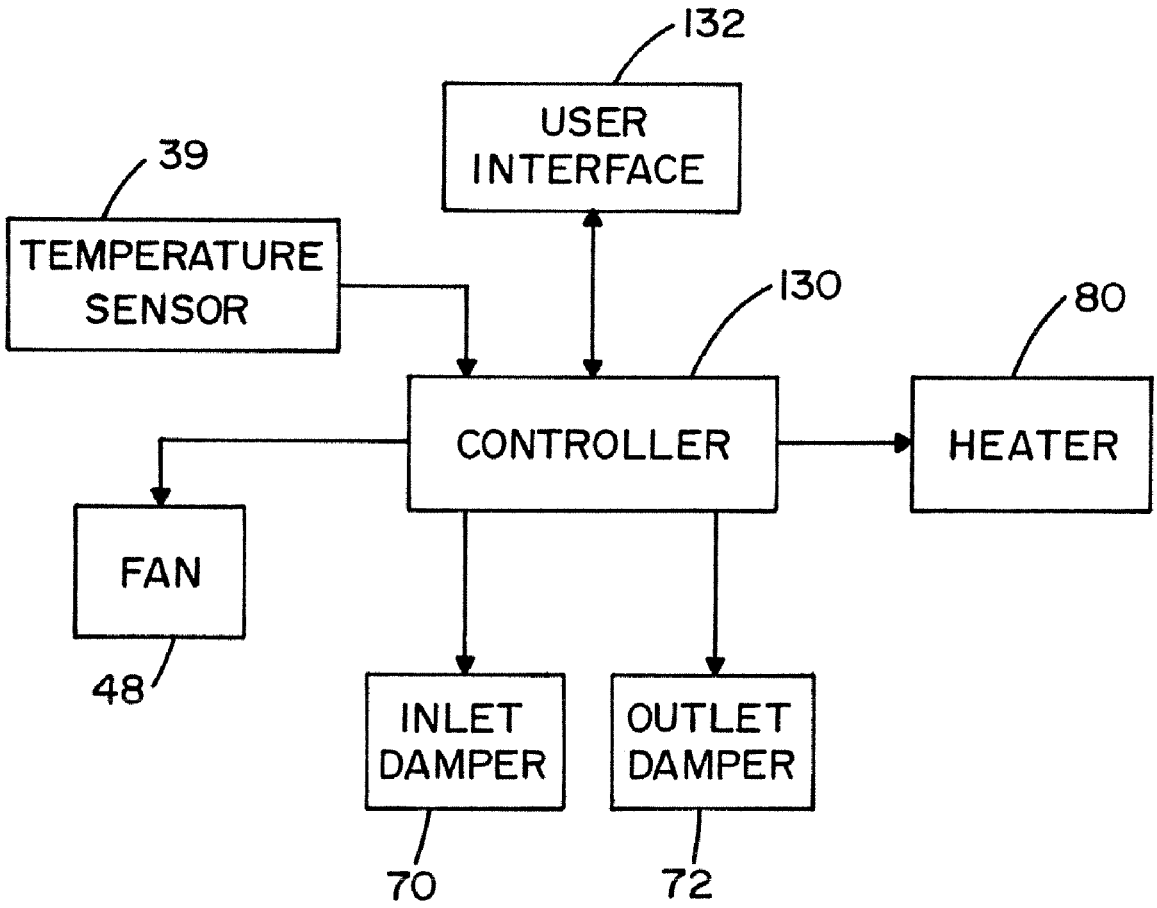
FIG. 5 is a schematic diagram of an illustrative control system for the dryer drawer of FIG. 1.

FIG. 5 schematically illustrates the control system for the drying drawer 30. Controller 130 receives inputs from user interface 132, and temperature sensor 39, and controls the operation of fan 48, heater 80, and dampers 70 and 72 to implement drying cycles for articles placed in drying drawer 30. Controller 130 may be a microchip based controller such as an appropriately programmed microprocessor or ASIC, or it may be a simple electromechanical device or array of such devices relying upon thermally responsive switching devices for controlling energization of the fan and heater and the opening and closing of the dampers 70, 72. The user interface may range in complexity from a simple on/off switch, to a multi-input human interface device enabling the user to select operating times, operating temperatures, desired dryness, etc, much like controls for a more conventional automatic clothes dryer. In the embodiments illustrated in FIGS. 1 and 2, the user interface comprises a manually actuable control knob 132*a* and display screen 132*b*.

A method for drying, in conjunction with the drying drawer 30, can shorten the drying cycle to minimize the time required to remove water from an article of clothing, shoes, etc. The method, to be described hereinafter, significantly reduces drying time and energy consumption using only temperature sensors, dampers 70, 72, and the small or low wattage heater 80.

As described above, a method for drying objects can include exhausting air 73 from the drawer through an exhaust duct 40 including dual acting damper 72 having an inlet connected with the drying chamber. Air can be drawn, i.e. ingested, into the drawer through intake duct 44 including dual acting damper 70 having an outlet connected with the chamber. A temperature sensor can be used for measuring the temperature in the drying chamber. Air can be streamed through the drying chamber in the first operational mode when the intake duct damper 70 and the exhaust duct damper 72 are opened (as seen in FIG. 5). Air can alternatively be recirculated (as seen in FIG. 6) within the drying chamber in the second operational mode when the intake duct damper 70 and the exhaust duct damper 72 are closed. Pivotal movements of dampers 70, 72 can be effected by electromechanical operation of a switch. The switch controls a linkage, such, for example, a flexible cable coupled at its other end with damper. Operation of the switches causes the dampers 70, 72 to be pivoted, jointly if desired, to one of their open or closed positions. Switching from a first operational mode to a second operational mode in a series of cycles can be initiated through the temperature sensor when a first predeterminable high temperature is reached and when a second predeterminable low temperature is reached, respectively. It is to be appreciated that at least one of the exhaust duct and the intake duct can include a variable orifice aperture (not shown). In addition, the intake duct 44 and the exhaust duct 40 may have apertures of different sizes and can be varied, i.e. variable orifice apertures, based on the selected operational mode. The intake duct size and the exhaust duct size can be varied during at least a portion of at least one of the first operational mode and the second operational mode. In one exemplary embodiment, the intake duct size is greater than the exhaust duct size. The drawer can include a series of gaps and holes to vent some of the air that is drawn in through the intake duct 44. The intake duct aperture size can vary in the range of 10 to 20 square inches and the exhaust duct aperture size can vary in the range of 2 to 4 square inches. In one exemplary arrangement, the intake duct aperture size can be in the range of 2 to 8 times the exhaust duct aperture size. In this manner, relatively more air can be ingested through the intake duct 44 relative to the amount of air being exhausted through the exhaust duct 40. Alternatively, the rate of air being exhausted can be greater than the rate of air being drawn in (ingested).

The drying chamber can include the multiple baffles 60, 61 disposed on walls inside the chamber for directing air within and around the articles in the chamber. In addition, the drying rack 90 can include a frame 92 that is foldable and/or removable from the chamber. The drying rack can include an accessory shelf 95 and an air diffuser 96. The drying rack 90 can include a pair of foldable shelves 93, 94 that can be used for supporting part of an article, i.e. sleeves S, in an elevated fashion separated from a remaining portion of the article (as seen in FIG. 2). In this manner, air can be effectively circulated around substantially all of the surface area of the clothing article C.

The rack 90 can be configured to enable placement of garments and garment sleeves to enhance drying time. The sleeve rack 90 enhances air flow to all areas of the sleeve and garment torso area. The integral racks 93, 94 on opposing sides of the wire baskets 92 provide for placement of garment sleeves whereby air flows to all surface areas of the garment enabling complete and efficient drying. Each sleeve of a garment can be placed on a sleeve rack such that the torso area of the garment lies separate from the sleeves of the wire basket 92 thereby allowing space and air flow between the sleeves and torso area of the garment.

As described, the dryer drawer system 10 includes a fan 48 for circulating air in the chamber. Air inlet 44 admits air into the multi-sided drying chamber via fan aperture 37. The air exhaust duct 40 guides exhausting air from outlet opening 43 to the exterior of the dryer drawer. In a first operational mode, controller 130 opens dampers 70 and 72 to provide air flow 62 through the chamber. In this mode fan 48 draws exterior air into the drying chamber through inlet 44 and moves it toward the front of the drying chamber where it returns to the exterior through outlet opening 43 and exhaust duct 40. In a second operational mode, controller 130 closes dampers 70 and 72 to provide a recirculating air flow 63 within the chamber. The airflow pattern in this mode is generally from the fan inlet area 46, proximate the rear of the chamber through the area of the chamber above partition 100 to the front wall 34 of the chamber returning to the fan inlet area 46 through the area beneath partition 100 via opening 101 in partition 100 and opening 45 in partition 35. The drying system operates in the first operational mode until the temperature in the chamber rises to a first predetermined temperature, for example _"XX"_degrees F. On reaching this temperature, the controller switches to the second operating mode and operates in this mode until the temperature in the chamber drops to a second predetermined temperature lower than the first predetermined temperature, for example "YY'_degrees F. Upon declining to this temperature, the controller switches back to the first operational mode and repeats the cycle. The system continues to cycle between the first operational mode and the second operational mode as a function of the sensed temperature in the chamber until the desired degree of dryness (i.e. RMC) is detected or a user selected cycle time has expired.

The drying chamber can include airflow 62 through the chamber in the first operational mode when the chamber is at a first temperature. And then the multi-sided drying chamber can include a recirculating airflow 63 within the chamber in the second operational mode when the chamber is at a second temperature. The heater 80 can raise the temperature of the articles within the chamber in order to evaporate moisture from the articles. The heater 80 can alternate between an "on" position for the first operational mode and an "off" position for the second operational mode. Particular arrangements and examples of the aforementioned system are shown in FIGS. 8-12 and will be described in detail hereinafter.

Figure 8:
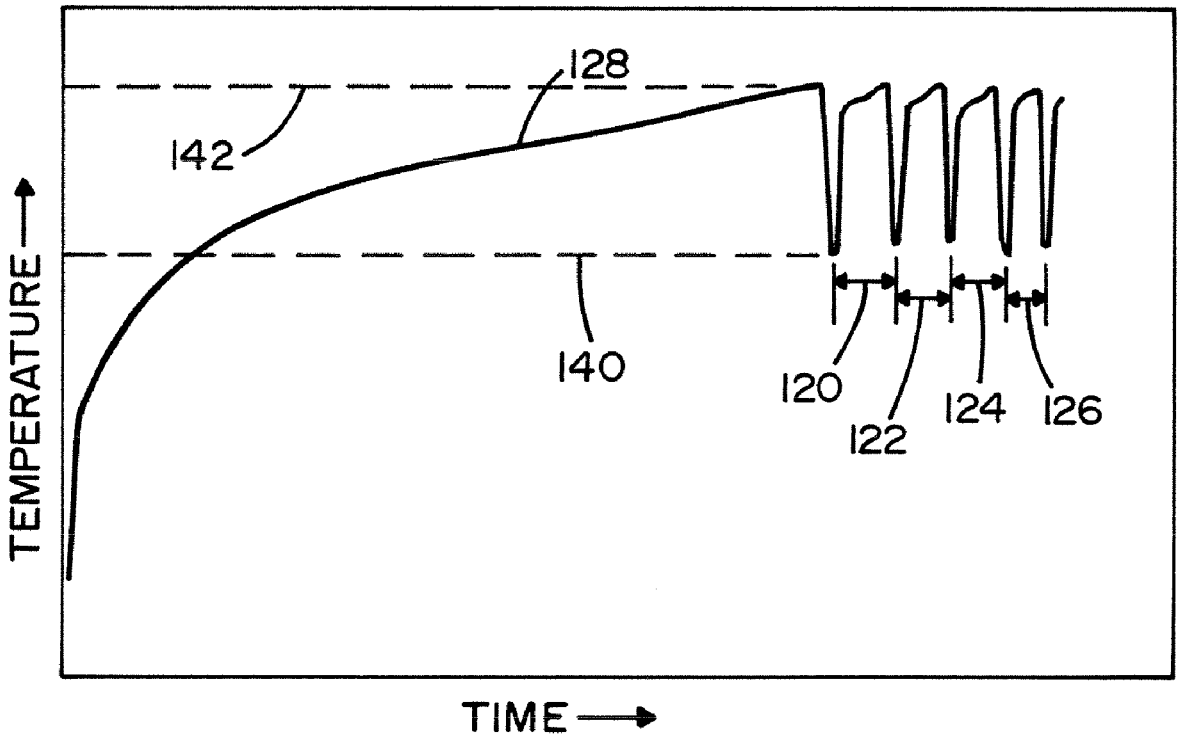
FIG. 8 displays a graph showing the relationship of time and temperature as the dryer drawer cycles from the first operational mode to the second operational mode.
Figure 9:
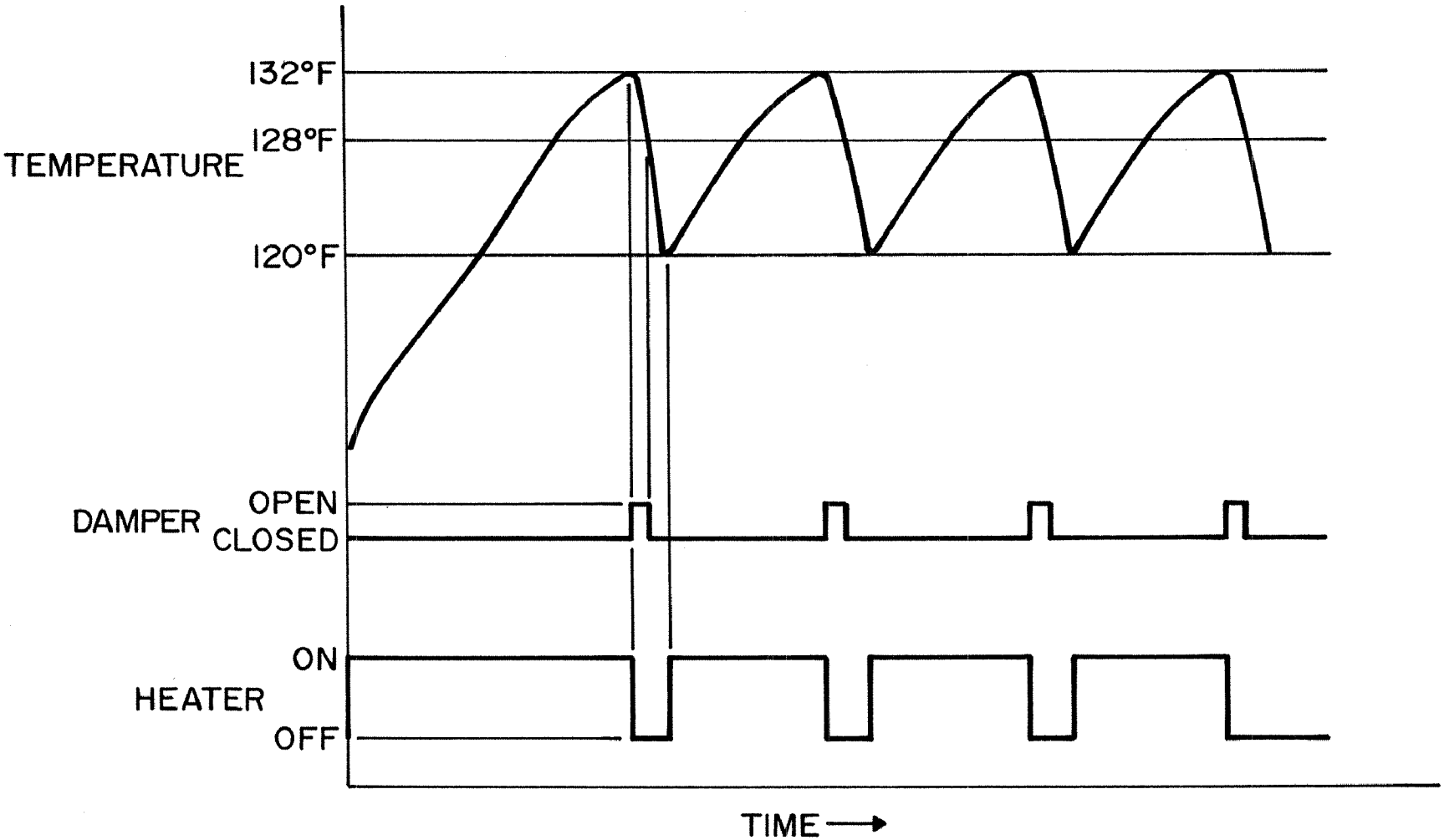
FIG. 9 is one exemplary arrangement of a control cycle for the dryer drawer.

As shown in FIG. 8, the drying cycle times or duration intervals 120, 122, 124, 126 can decrease with decreasing RMC. The figure shows that as the heater discharge temperature increases, and particularly during the ramp up phase 128, the damper and heater cycling time decrease 120, 122, 124, 126 corresponding with the RMC decrease between, for example, a low threshold temperature 140 and a high threshold temperature 142. FIG. 8 shows one exemplary profile for a typical drying cycle of the appliance 10. Each of the cycles 120, 122, 124, 126, namely the duration, can progress in a manner such that the present cycle duration is less than the previous cycle duration based on, for example, a predeterminable percentage or proportion of the remaining moisture content (RMC) or desired degree of dryness of the articles within the chamber (refer to FIG. 8). In this manner the time between temperature peaks can be a function of a first and a second predeterminable moisture content of the articles within the chamber. As such, the cycles can correspond, i.e. decline in duration, as the remaining moisture content of the articles inside the drying chamber declines. It is to be appreciated that the cycle duration between each temperature peak (i.e. time between temperature peaks) progressively decreases in accordance with the RMC of the contents inside the drying chamber FIG. 9 displays another exemplary arrangement of a control cycle. As shown (i.e. 'Generation I' cycle), the control cycle can ramp up the temperature to, for example, 132° with the damper closed. At 132°, the heater can be turned off and the damper opened. Once the temperature decreases to, for example, 128°, the damper is closed. And finally, once the temperature decreases to, for example, 120°, the heater is once again turned on.

Quantified results have shown that a pair of tennis shoes using the aforementioned drying drawer can reach 6% RMC ten times faster than shoes in a rack dry which are found in current household dryers. This improved shortened drying cycle can also be accomplished using the dryer drawer heater 80 which can be approximately 10%, or less, of the wattage used in today's current household drum dryers.

Figure 10:
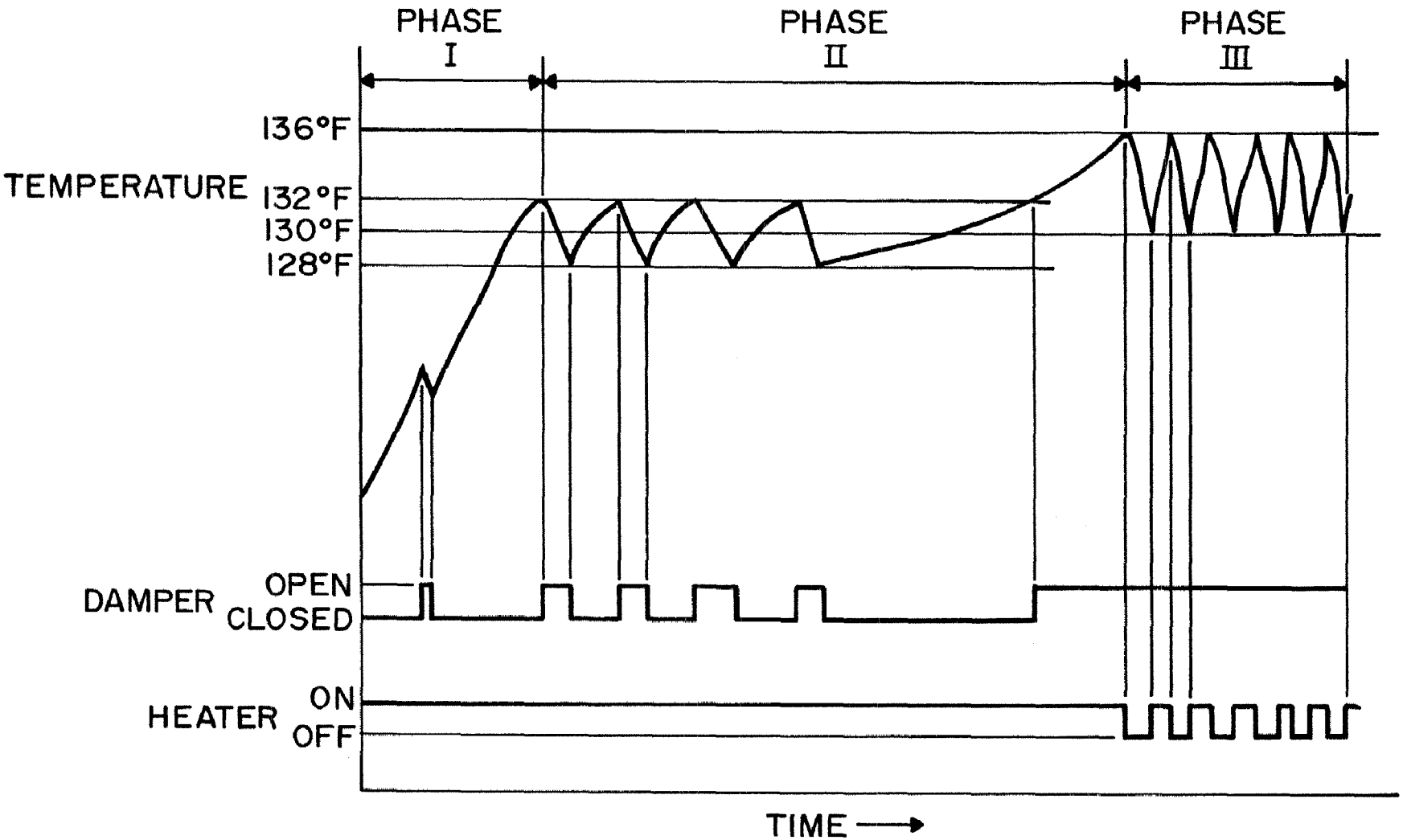
FIG. 10 is another exemplary arrangement of a control cycle for the dryer drawer.

FIG. 10 displays yet another exemplary arrangement of a drying method of the present disclosure which utilizes three distinct phases: phase I, phase II, and phase III (i.e. 'Generation II' cycle). Phase I, also called ramp up, can be used to bring the internal temperature of the drying compartment up to a temperature (i.e. 132 degrees F.), and this can be accomplished by circulating internal compartment air with fan while applying low wattage heat. During phase I, the internal air is exchanged with external air by opening the pair of dampers 70, 72 (inlet and outlet dampers), and forcing air to flow through the compartment using fan 48. The air exchange frequency is determined by elapsed time, coupled with damper open time.

Phase II is started when Phase I ramps up to a "T1 High" (i.e. 132 degrees F.). Phase II, also called the evaporative phase, works by controlling the temperature modulating dampers 70, 72 while the low wattage heater 80 is on. The dampers 70, 72 are opened when the internal compartment temperature reaches a "T2 High" (i.e. 132 degrees) and then the dampers are closed when the internal temperature reaches a "T2 Low" (i.e. 128 degrees). Fan 48 re-circulates air when dampers 70, 72 are closed, or exchanges outside air when the dampers 70, 72 are open.

Phase III starts when dampers 70, 72 are opened during Phase II and the internal compartment temperature still rises even though the dampers 70, 72 remain open. Phase III, also called the final phase, comprises leaving the dampers 70, 72 open with the fan 48 on. The low wattage heater 80 can be turned off when the internal compartment temperature reaches a "T3 High" (i.e. 136 degrees) and turned back on when the internal compartment temperature falls to a "T3 Low" (i.e. 130 degrees). The cycle control can continue until a predetermined RMC is achieved for the contents inside the drying chamber.

Figure 11:
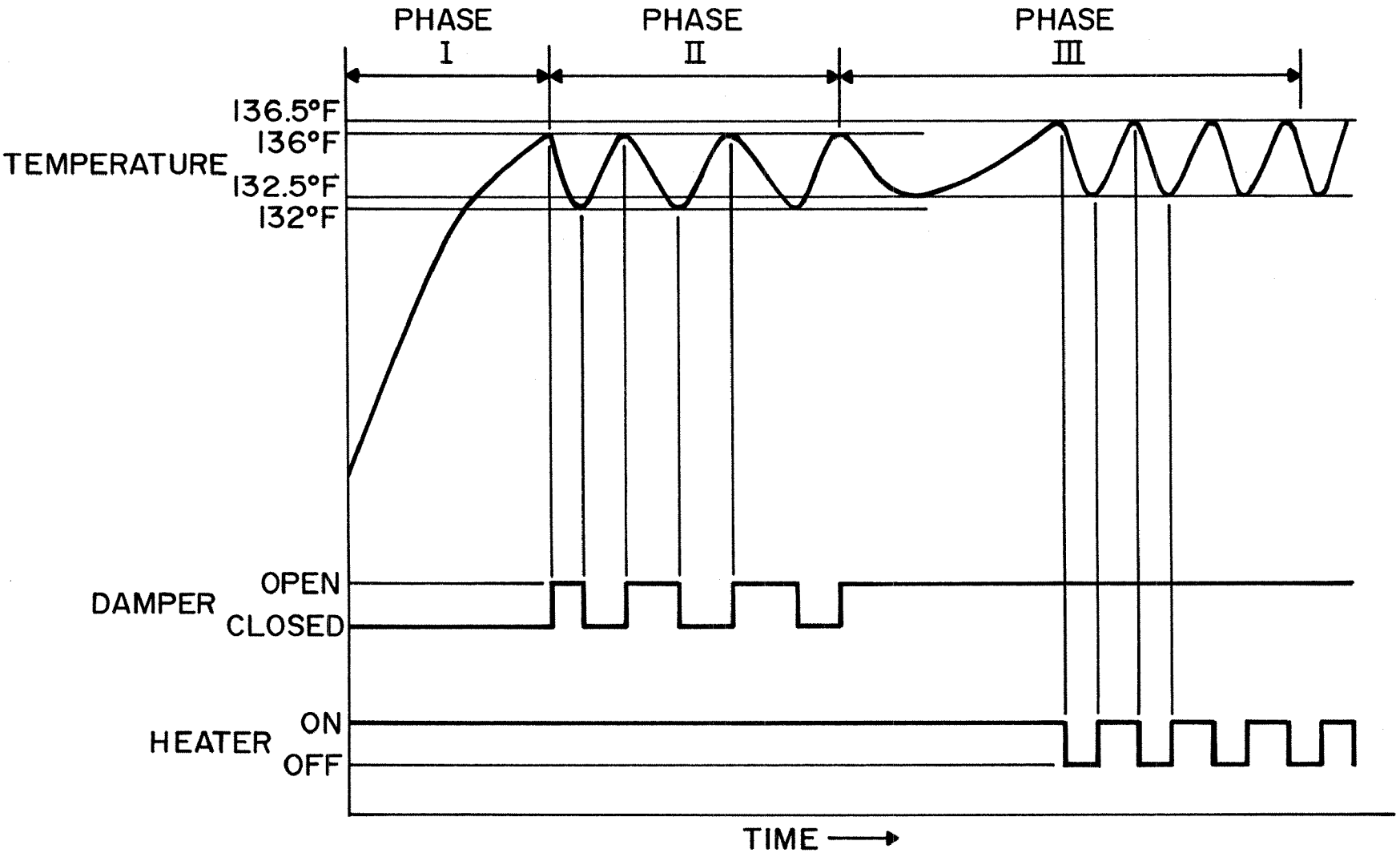
FIG. 11 is yet another exemplary arrangement of a control cycle for the dryer drawer; and, FIG. 12 is still another exemplary arrangement of a control cycle for the dryer drawer.

Referring now to FIG. 11, another exemplary control cycle (i.e. 'Generation III') is therein shown for controlling the drying cycles of the dryer drawer. As displayed, the drying method can also utilize three distinct phases: phase I, phase II, and phase III. Phase I, also called ramp up, can be used to bring the internal temperature of the drying compartment up to a temperature (i.e. 136 degrees F.) while the dampers are closed.

Phase II is started when Phase I ramps up to a "T1 High" (i.e. 136 degrees). Phase II works by controlling the temperature modulating dampers 70, 72 while the low wattage heater 80 remains on. The dampers 70, 72 are opened when the internal compartment temperature reaches a "T2 High" (i.e. 136 degrees) and then the dampers are closed when the internal temperature reaches a "T2 Low" (i.e. 132 degrees).

Phase III starts when dampers 70, 72 are opened during Phase II and the internal compartment temperature still rises (i.e. greater than 136 degrees) even though the dampers 70, 72 remain open. Phase III, also called the final phase, comprises leaving the dampers 70, 72 open with the fan 48 on. The low wattage heater 80 can be turned off when the internal compartment temperature reaches a "T3 High" (i.e. 136.5 degrees) and turned back on when the internal compartment temperature falls to a "T3 Low" (i.e. 132.5 degrees). The cycle control can continue until a predetermined RMC is achieved.

Figure 12:
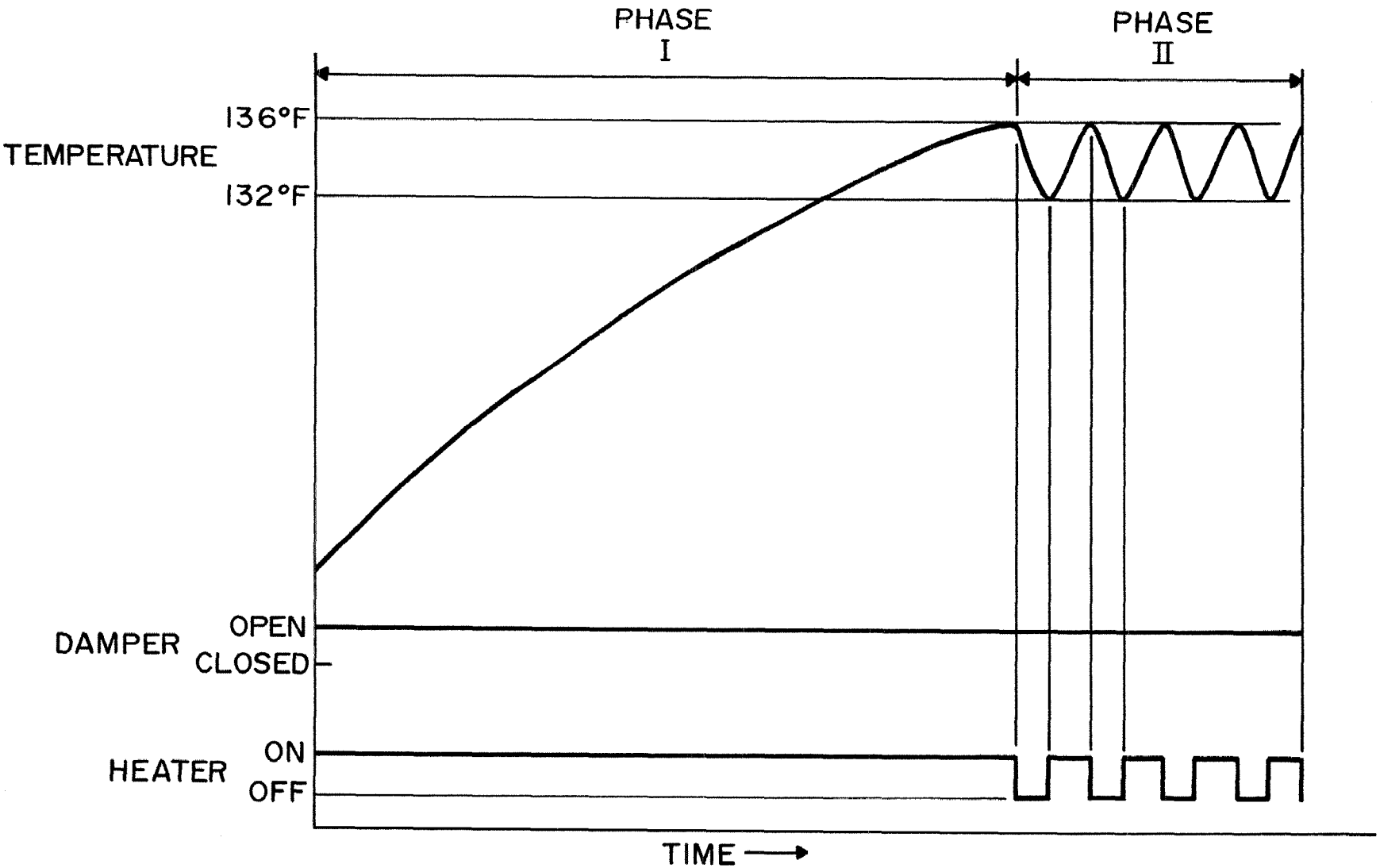

Referring now to FIG. 12, another exemplary control cycle (i.e. 'Generation IV') is therein shown for controlling the drying cycles of the dryer drawer. As displayed, the drying method can utilize two distinct phases: phase I and phase II. Phase I can be used to bring the internal temperature of the drying compartment up to a temperature (i.e. 136 degrees F.) while the dampers are opened.

Phase II is started when Phase I ramps up to a "T1 High" (i.e. 136 degrees). Phase II works by controlling the heater and cycling the heater from on to "off" while the dampers remain in the open position. Phase II, for this control cycle, comprises leaving the dampers 70, 72 open and cycling the heater from "off" to "on" as the internal compartment temperature moves from, for example, 136 degrees to 132 degrees, respectively. The cycle control can continue until a predetermined RMC, or predetermined percentage of an RMC, is achieved.

It is to be understood that the present disclosure is not limited to the embodiments and particular temperature thresholds described above, but encompasses any and all embodiments within the scope of the following claims.

The invention claimed is:

1. A dryer drawer system, comprising:

a generally multisided drying chamber having opposed side walls, a rear wall, and at least one access door, wherein said door is sealable to said chamber;

a heater for heating air circulating in said chamber;

at least one fan for circulating air in said chamber;

said multisided drying chamber including an air inlet and an air outlet;

a sensor for sensing the temperature of the air in said chamber;

a first damper for selectively opening and closing said air inlet;

a second damper for selectively opening and closing said air outlet;

a controller for controlling operation of said fan, said heater and said dampers, said controller being operative in a first operational mode to open said air inlet and said air outlet to provide air flow through said chamber and in a second operational mode to close said air inlet and said air outlet to provide a recirculating air flow within said chamber; and, said controller selectively switching between said first and second operational modes as a function of the sensed temperature in said chamber.

2. The dryer drawer system according to claim 1, wherein said controller turns said heater on for said first operational mode and off for said second operational mode.

3. The dryer drawer system according to claim 1, wherein:

said controller switches from said first operational mode to said second operational mode when a first predetermined temperature is sensed and switches from said second operational mode to said first operational mode when a second predetermined temperature is reached, said second predetermined temperature being lower than said first predetermined temperature.

4. The dryer drawer system according to claim 1, wherein at least one of said air inlet and said air outlet includes a variable orifice aperture.

5. The dryer drawer system according to claim 3, wherein said intake duct aperture includes a size and said exhaust duct aperture includes a size, wherein said intake duct size and said exhaust duct size are varied during at least a portion of at least one of said first operational mode and said second operational mode.

6. The dryer drawer system according to claim 3, wherein said intake duct aperture includes a size and said exhaust duct aperture includes a size, wherein said intake duct size is greater than said exhaust duct size.

7. The dryer drawer system according to claim 6, wherein said intake duct aperture size is in the range of 2 to 6 times said exhaust duct aperture size.

8. The dryer drawer system according to claim 1, wherein each subsequent cycle duration is less than a previous cycle duration.

9. The dryer drawer system according to claim 1, wherein an end of cycle is detected based on a predeterminable percentage of a remaining moisture content (RMC) of the articles.

10. The dryer drawer system according to claim 1, wherein said cycles correspond to a remaining moisture content (RMC) of contents inside said drying chamber.

11. The dryer drawer system according to claim 8, wherein decreasing durations between each temperature peak of each said cycle corresponds to a decreasing RMC of contents inside said drying chamber.

12. The dryer drawer system according to claim 1, further comprising a first damper operative to selectively open and close said air outlet; and a second damper operative to selectively open and close said air inlet;

said first damper and said second damper are operative to open said air outlet and said air inlet respectively in said first operational mode; and, at least one of said first damper and said second damper are operative to close said air outlet and said air inlet respectively in said second operational mode.

13. A dryer drawer, comprising:

a generally multisided drying chamber having opposed side walls, a rear wall, and at least one access door;

said drying chamber including an air inlet and an air outlet;

a sensor for measuring temperature in said chamber;

said multisided drying chamber including a air flow through said chamber in a first operational mode when said chamber is at a first temperature;

said multisided drying chamber including a recirculating air flow within said chamber in a second operational mode when said chamber is at a second temperature; and, a heater for heating the air circulating in said chamber to evaporate moisture from articles in said chamber, wherein said heater alternates between on for said first operational mode and off for said second operational mode.

14. The dryer drawer according to claim 13, further comprising:

at least one baffle disposed on a wall of said drying chamber for directing air.

15. The dryer drawer according to claim 13, further comprising:

at least one drying frame rack spaced along said opposed walls of said drying chamber; and, at least one rack spaced above said bottom wall.

16. The dryer drawer according to claim 15, wherein said rack comprises a basket frame that is foldable or removable from said chamber.

17. The dryer drawer according to claim 13, further comprising:

a drip shield located proximal to the bottom wall of said dryer chamber, wherein said drip shield separates a low pressure side from a high pressure side of the fan.

18. The dryer drawer according to claim 17, wherein said drip shield includes a material selected from the group consisting of plastic, glass, and metal including a heat source for generating local heat to the articles proximal to said shield.

19. The dryer drawer according to claim 13, wherein said dryer drawer comprises an integral drip shield including air return paths therearound for increasing air circulation with said chamber.

20. The dryer drawer according to claim 13, further comprising:

at least a second dryer drawer stacked upon said at least one dryer drawer wherein said at least one dryer drawer is mounted to said at least second dryer drawer.

21. The dryer drawer according to claim 13, wherein said temperature change corresponds to a remaining moisture content (RMC) of articles inside said drying chamber.

22. The dryer drawer according to claim 13, further comprising a first damper for selectively opening and closing said air outlet;

a second damper for selectively opening and closing said air inlet opening;

said first damper and said second damper are operative to open said outlet opening and said inlet opening respectively in said first operational mode; and, at least one of said first damper and said second damper are operative to close said outlet opening and said inlet opening respectively in said second operational mode.

23. A method of drying articles, comprising:

heating a drying chamber with a heater, wherein said chamber includes a generally multisided drying drawer having opposed side walls, a rear wall, and at least one access door;

exhausting air from said drawer through an air outlet including a first damper for selectively opening and closing said air outlet;

drawing air into said drawer through an air inlet including a second damper for selectively opening and closing said air inlet;

measuring a temperature in said drawer;

streaming air through said drawer in a first operational mode when said first damper and said second damper are opened;

recirculating air within said drawer in a second operational mode when said first damper and said second damper are closed; and, switching in a series of cycle durations from said first operational mode to said second operational mode when a first predetermined criteria is reached and from said second operational mode to said first operational mode when a second predetermined criteria is reached.

24. The method of drying articles according to claim 23, further comprising:

alternating said heater between on and off for said first operational mode and said second operational mode, respectively.

25. The method of drying articles according to claim 24, wherein said cycle duration corresponds to a remaining moisture content (RMC) of articles inside said drying chamber including a first predeterminable RMC and a second predeterminable RMC.

* * * * *